United States Patent [19]

Beyl et al.

[11] Patent Number: 4,494,769

[45] Date of Patent: Jan. 22, 1985

[54] SKI-BINDING TOE ABUTMENT MEMBER FOR A SKI BOOT HAVING A TRUNCATED SOLE

[75] Inventors: Jean J. A. Beyl; Philippe Buzon, both of Nevers; Christian Campillo, Garchizy; Jackie Cursillat, Germigny sur Loire; Daniel Le Faou, Vauzelles; Henri Peyre, Nevers, all of France

[73] Assignee: Ste Look, Nevers, France

[21] Appl. No.: 386,662

[22] Filed: Jun. 9, 1982

[30] Foreign Application Priority Data

Jun. 30, 1981 [FR] France ..... 81 12819

[51] Int. Cl.[3] ..... A63C 9/085

[52] U.S. Cl. ..... 280/630; 280/634

[58] Field of Search ..... 280/625, 626, 627, 628, 280/629, 630, 631, 632, 633, 634, 613

[56] References Cited

U.S. PATENT DOCUMENTS 3,865,388 2/1975 Haldemann ..... 280/613
3,936,065 2/1976 Ramillon ..... 280/634
4,362,313 12/1982 Andrieu ..... 280/628
4,398,747 8/1983 Bernard ..... 280/634
4,401,318 8/1983 Beyl ..... 280/625

FOREIGN PATENT DOCUMENTS 2707149 8/1978 Fed. Rep. of Germany ..... 280/613

*Primary Examiner*—Joseph F. Peters, Jr.
*Assistant Examiner*—Michael Mar
*Attorney, Agent, or Firm*—Bierman, Bierman & Peroff

[57] ABSTRACT

The toe abutment member of a ski binding is adapted to cooperate with a ski boot provided with a sole having a truncated front end and a toe-cap extension in overhung relation to the truncated front end. The abutment member comprises a feeler element placed directly beneath the toe-cap extension of the ski boot in close proximity to the toe-cap extension under normal skiing conditions. In the event of a forward fall, the feeler element undergoes a vertical displacement in the downward direction under the thrust exerted by said extension while producing a reduction in inherent stiffness of release of the toe abutment member.

7 Claims, 13 Drawing Figures

1
2a
1a
4
II
18
24
17
14
22
23
2
II
6
13
21
19
11
5
3

SKI-BINDING TOE ABUTMENT MEMBER FOR A SKI BOOT HAVING A TRUNCATED SOLE

This invention relates to the toe abutment member of a ski binding, said member being adapted to cooperate with a ski boot in which the sole of the boot has a truncated toe end, with the result that the front portion of the ski-boot upper is in an overhung position in front of said truncated toe end.

The abutment member is of the type comprising a jaw unit formed by two arms for retaining the truncated front portion of the sole. Said jaw unit is rotatably mounted on at least one vertical pivot and cooperates with a resilient mechanism for normally locking the arms in the boot-retaining position with an adjustable force designated as the inherent stiffness of release.

Toe abutment devices of this type are provided in some cases with a feeler member which is adapted to be in contact with the front portion or toe end of the ski boot and to produce action on the resilient mechanism in the event of a forward fall with a view to reducing the inherent stiffness of release.

A known type of toe abutment member was also disclosed in French Pat. No. 71 22 859 (publication No. 2 099 849). In this specification, the torsional stiffness of the abutment member decreases in the event of a forward fall. This is achieved by means of an element such as a diaphragm which is sensitive to the increase in pressure produced at the time of the forward fall, this element being located beneath the skier's big toe. The increase in pressure within said element is transmitted to the regulating mechanism which serves to adjust torsional stiffness in order to reduce said stiffness.

This design calls for a complicated transmission device between the bottom face of the sole and the stiffness adjustment mechanism. A further drawback of this device lies in the fact that, after ski-jumping or passing over a hump, and at the moment when the skier lands flat on his skis, the element which is sensitive to the pressure of the foot is necessarily actuated even if the skier is not in a dangerous situation. The abrupt reduction in stiffness of release which accordingly results may also produce an accidental release.

German patent application published under No. 2,905,837 also describes a toe abutment unit provided with a feeler device which is responsive to pressure and placed beneath the front end of the boot. Said device can be constituted, for example, by a flexible air-filled bag connected to the resilient mechanism by means of a pipe, or alternatively by crank-arms capable of actuating a link-rod which cooperates with a rocker and this latter produces action on the resilient mechanism so as to reduce the stiffness at the time of a forward fall.

These designs are all subject to the same disadvantages as French Pat. No. 71 22 859, especially by reason of the potential danger of accidental release of the ski when this latter passes over a hump. The first Addition No. 78 802 to French Pat. No. 1,220,819 discloses a ski binding device comprising a link-rod system associated with an elastic member and so arranged that lifting of the heel of the ski boot causes the link-rod system to lift under the action of the elastic restoring member and produces correlatively a reduction in the force with which the torsional retaining member is applied at the front end of the ski binding.

This design is complicated by the fact that it calls for the arrangement of a mechanism beneath the ski boot.

Furthermore, it is liable to jam very readily as a result of accumulation of snow or as a result of frost by reason of the complicated link-rod system placed between the boot and the ski.

The aim of the present invention is to overcome all these disadvantages by proposing a toe abutment member adapted to cooperate with a ski boot provided with a sole having a truncated front end above which the front end portion of the boot upper is in an overhung position. The toe abutment member is consequently both simple to construct and highly reliable without any attendant danger of release when the ski passes over a hump. A ski boot of this type is described, for example, in French Pat. No. 77 36 281 (publication No. 2,410,447).

According to the invention, the feeler element is placed beneath the front portion of the ski-boot upper in a position of close proximity to said front portion under normal skiing conditions and is capable of vertical displacement in such a manner as to undergo a downward movement under the thrust exerted by said front portion of the upper in the event of a forward fall while at the same time producing a reduction in stiffness of release.

Thus the feeler element is placed directly above the resilient locking mechanism, thus making it possible in particular to dispense with complicated transmission components and therefore considerably simplifying the construction of the device.

In one embodiment of the invention in which the resilient locking mechanism comprises a U-shaped piston housed within a box unit and capable of displacement in sliding motion along the longitudinal axis of the ski, said piston being continuously urged by at least one spring against a flat face of the retaining jaw unit, the feeler element consists of a yoke extending transversely with respect to the ski. Said yoke is provided with two lateral arms interposed between the sides of the piston and the box unit and adapted to cooperate with lateral lugs of the piston. During normal skiing, the lugs therefore maintain the yoke in the raised position by producing action on its lateral arms. In the event of a forward fall of the skier, the front portion of the ski-boot upper causes a downward pivotal displacement of the yoke about an axis transverse to the ski whilst the lateral arms of the yoke exert correlatively on the lugs a thrust which moves the piston away from the flat bearing face of the jaw unit.

In the position corresponding to normal skiing, the piston which is thrust back by the resilient locking system continuously exerts pressure on the lateral arms of the yoke by means of the lateral lugs of said piston whilst the cross-piece of said yoke forming a pedal is inclined to the horizontal in order to permit a pivotal displacement of the yoke as a whole.

In a second possible form of construction, the piston is provided on that face which is applied against the flat bearing face of the jaw unit with a lug having an inclined face or ramp against which is slidably applied a push-member provided with a corresponding ramp and constituting the feeler element, said push-member being slidably mounted around the stationary pivot for vertical displacement on said pivot and resiliently urged to its raised position by the lug of said piston.

In the event of a forward fall, the projecting front portion of the ski-boot toe-cap is applied against the push-member which undergoes a downward displacement along the pivot, initiates a relative sliding displacement of the push-member ramp and piston-lug ramp, thereby moving said piston and lug away from the flat bearing face and producing a reduction in stiffness of release.

This form of construction is also very simple and reliable, and is not liable to become clogged by accumulation of snow or mud.

According to a particular feature which is also provided by the invention, the top face of the feeler element is constituted by small detachable bearing plates formed of material having a low coefficient of friction.

By making provision for a set of bearing plates having different thicknesses, it is possible to adjust the height of the feeler element with respect to the ski boot in order to ensure that the surface of the feeler element is practically in contact with the projecting end of the ski-boot toe-cap without being subjected to any pressure by the boot except in the event of a forward fall.

Other features of the invention will be more apparent upon consideration of the following description and accompanying drawings, wherein :

FIG. 2 is a fragmentary part-sectional horizontal top view taken along line II—II of FIG. 1;

Figure 10:
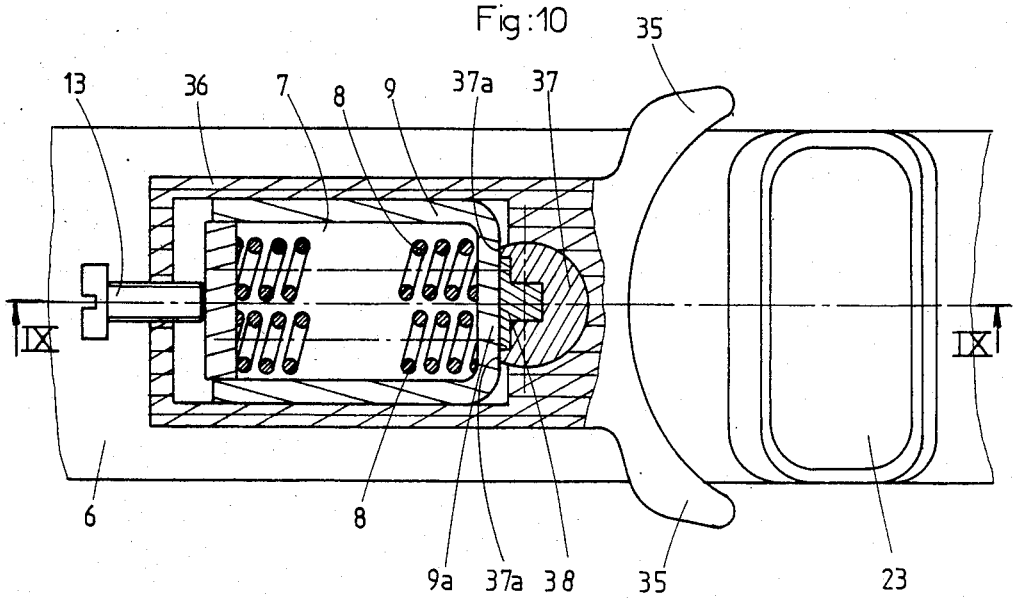
FIG. 10 is a fragmentary part-sectional horizontal top view taken along line X—X of FIG. 9.
Figure 10A:
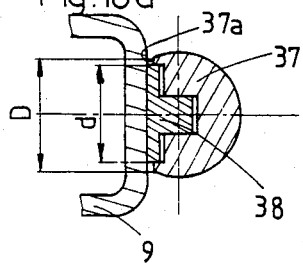
Figure 11:
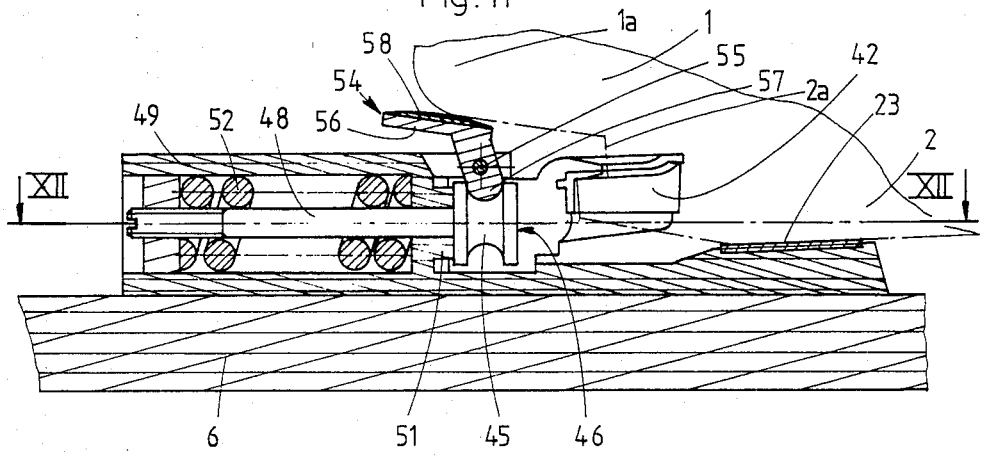
Figure 12:
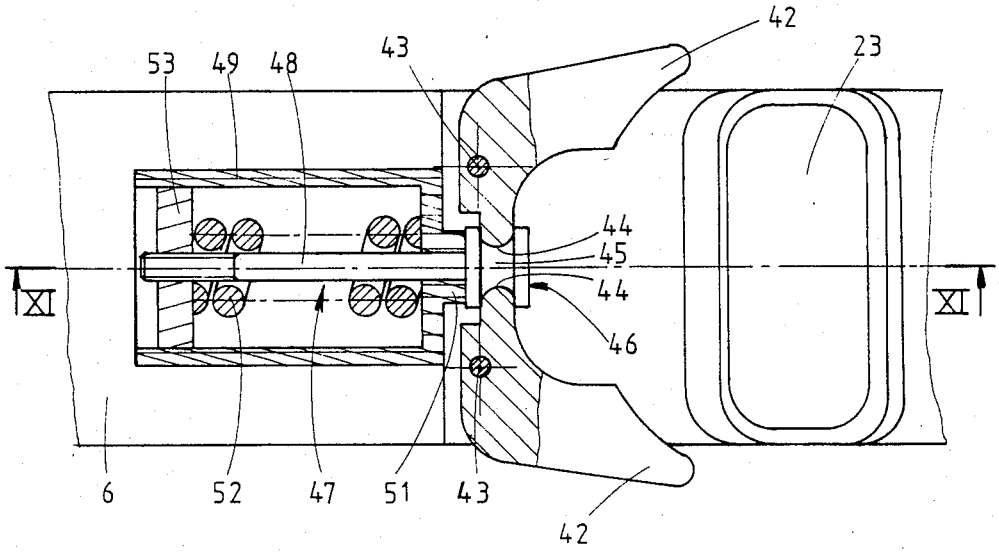

FIG. 10*a* is a detail of FIG. 10 showing the piston in a position in which it has moved away from its flat bearing face as a result of a forward fall;

FIG. 11 is a longitudinal sectional view taken along line XI—XI of FIG. 12 and showing a fourth embodiment of the toe abutment member according to the invention;

FIG. 12 is a fragmentary part-sectional horizontal top view taken along line XII—XII of FIG. 11.

The ski-binding toe-abutment member shown in FIGS. 1 to 4 is intended to cooperate with a ski boot 1, the sole 2 of which has a truncated front end or "toe" end 2*a*. In consequence, the front portion 1*a* of the "upper" or toe-cap of the ski boot 1 is located in an overhung position in front of the truncated toe end 2*a*.

It should be noted that the front end of the ski is located on the left-hand side of the figures.

The abutment member comprises a jaw unit 3 formed by two arms 4 for retaining the front portion of the ski boot 1, said arms being adapted to receive the truncated toe end 2*a*. The jaw unit 3 is rotatably mounted on a vertical pivot 5 secured to the ski 6 and adapted to cooperate with a resilient locking mechanism 7 which normally serves to lock the arms 4 in the boot-retaining position with an adjustable force designated as "inherent stiffness of release".

In this example, the resilient locking mechanism 7 comprises two helical springs 8 placed within a U-shaped piston 9 having a cross-piece 9*a* which is maintained by the springs 8 applied against a flat bearing face 11 formed vertically on the jaw unit 3. The springs 8 are applied against a member 12 placed between the lateral arms of the piston 9 and traversed by a screw 13 for adjusting the stiffness of the springs 8.

The resilient locking mechanism 7 is housed within a box 14 provided on the side nearest the jaw unit 3 with an opening into which said jaw unit is adapted to penetrate so that the flat bearing face 11 of said jaw unit can effectively come into contact with the piston 9. Small plates 15 of plastic material and preferably having good sliding properties are interposed between the lateral arms of the piston 9 and the walls of the box 14. The small plates 15 can be constituted by vertical partition-walls which are integral with the base plate of the toe abutment member. Within the small plates 15 are formed elongated slots 16, the function of which will be explained hereinafter.

The box 14 is in turn contained within a protective casing 17 which is attached to the ski 6.

According to the invention, the toe abutment member is provided with a feeler element 18 placed beneath the projecting front portion 1*a* of the ski-boot upper 1 and nearly in contact with said front portion during normal skiing conditions. Said feeler element 18 is capable of vertical displacement in such a manner as to undergo a downward movement under the thrust exerted by the projecting front portion 1*a* in the event of a forward fall, while at the same time producing a reduction in stiffness of release of the resilient locking mechanism 7.

More specifically in the example herein described, the feeler element 18 is constituted by a yoke extending transversely with respect to the ski 6 and provided with two lateral arms 19 fitted within the elongated slots 16. The piston 9 is provided with two lugs 21 which project within the elongated slots 16 in contact with the lateral arms 19. Under the thrust exerted by the springs 8, the lugs 21 continuously apply pressure to the lateral arms 19, thereby tending to maintain said arms in the substantially vertical position of FIG. 1 corresponding to a raised position of the cross-piece of the yoke 18.

The yoke 18 is therefore carried by the cover of the box 14 which is provided with openings for the insertion of the lateral arms 19. Said arms are provided at the level of the cover of the box 14 with notches 22 in which the edge of said box cover is inserted.

By means of the notches 22, the feeler assembly constituted by the yoke 18 is permitted to undergo a pivotal displacement about an axis at right angles to the ski 6 when the projecting front portion 1*a* of the ski boot is applied against said yoke 18.

Suitable sealing means such as bellows seals (not shown for the sake of simplification) can be provided in order to prevent snow or ice from penetrating on the one hand between the transverse portion or foot-pedal crosspiece of the feeler element 18 and the top of the casing 17 and on the other hand into the interior of the box 14.

The front portion or toe end of the sole 2 rests on a toe plate 23 having a low coefficient of friction and carried by the base plate of the toe abutment member.

There is fixed on the top face of the yoke 18 a small bearing plate 24 which also has a low coefficient of friction (and may be formed of material such as PTFE, for example). Provision can advantageously be made for detachable mounting of the bearing plate 24, for example by means of a clip-attachment system. In such a case, a bearing plate could readily be replaced by a plate of different thickness in order to take into account inevitable differences in both dimensions and extent of wear of different ski boots. It is in fact important to ensure that the feeler element 18 is not actuated while normal skiing is in progress but only in the event of forward inclination of the skier's body.

The operation of the toe abutment member which has been described in the foregoing is as follows.

Figure 1:
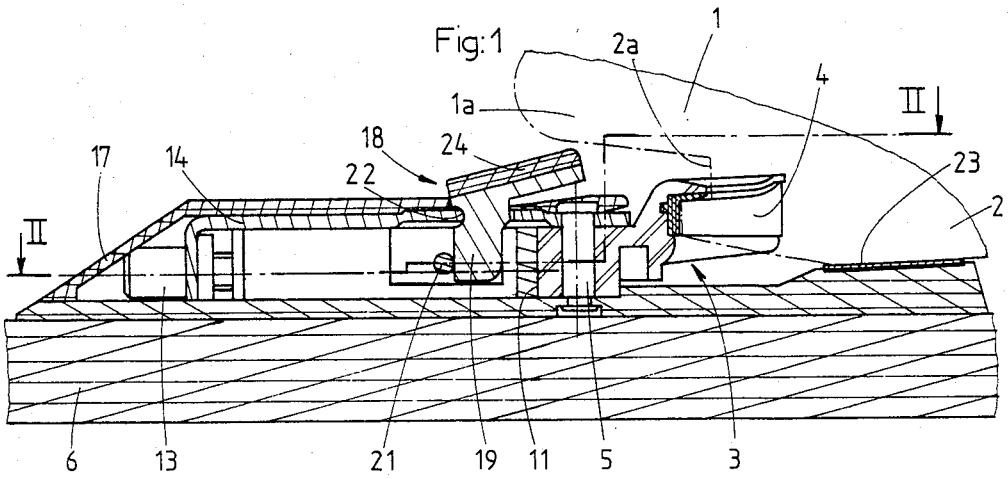
FIG. 1 is a longitudinal sectional view taken along line I—I of FIG. 2 and showing a first embodiment of the toe abutment member, the feeler element being shown in the raised position.

During normal skiing, the feeler element and the ski boot 1 are in the respective positions shown in FIG. 1. The cross-piece of the feeler element 18 is inclined to the horizontal and its top edge is nearly in contact with the projecting front portion 1*a* of the ski boot. In the event of a forward fall (as shown in FIGS. 3 and 4), the overhanging front portion 1*a* of the ski boot 1 exerts a downward thrust on the feeler yoke 18, with the result that said yoke 18 undergoes a pivotal displacement about the transverse axis extending between the notches 22 until it reaches the position shown in FIGS. 3 and 4.

Figure 3:
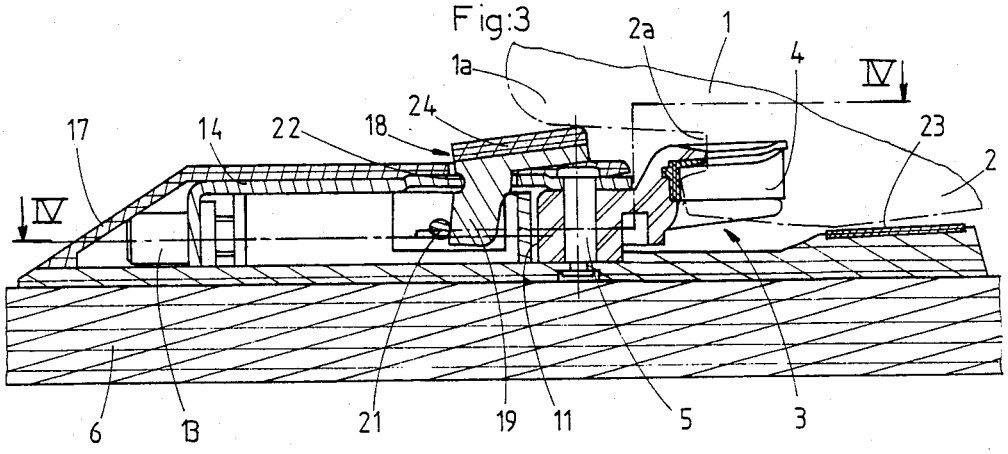
FIG. 3 is a longitudinal vertical sectional view in partial elevation, taken along line III—III of FIG. 4 and showing the feeler element in the lowered position at the time of a forward fall.
Figure 4:
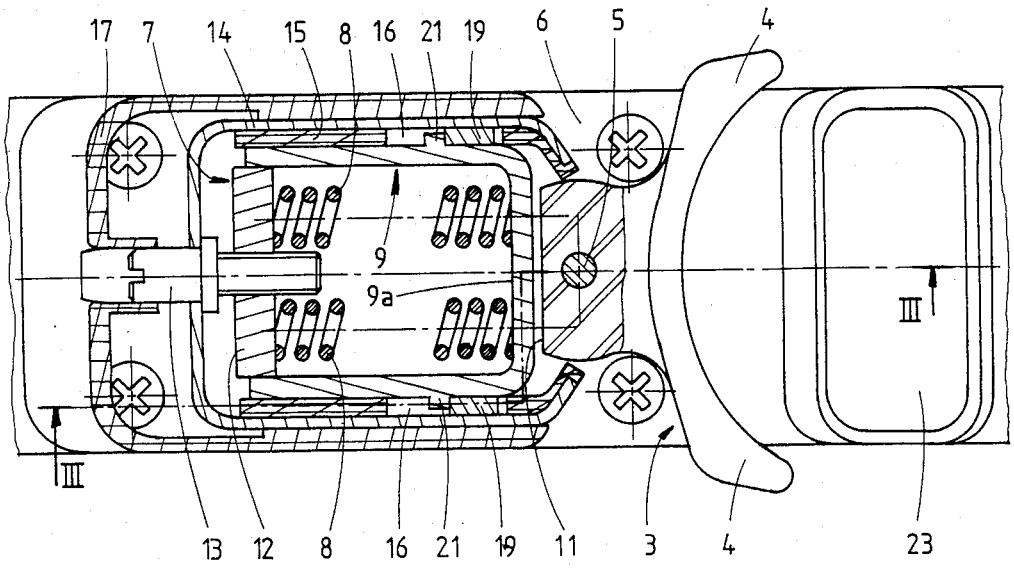
FIG. 4 is a fragmentary part-sectional top view taken along line IV—IV of FIG. 3.

During pivotal displacement of the yoke 18, the lateral arms 19 undergo the same pivotal displacement and consequently exert on the lugs 21 a force which is directed towards the front end of the ski and causes the piston 9 to move forward to a slight extent with respect to the flat bearing face 11 while compressing the springs 8 as shown in FIGS. 3 and 4. The jaw unit 4 is therefore capable of pivoting freely over a predetermined range of angular travel. Tests have shown that this freedom of initial angular displacement of the jaw unit about its vertical pivot 5 compensated for the parasitic friction forces developed between the front end of the ski boot and the toe plate 23 as well as between the front end of the ski boot and the jaw unit 4 as a result of forward inclination of the skier's body, with the result that stiffness of release of the toe abutment member under torsional stress is maintained approximately constant irrespective of the degree of forward inclination of the skier's body.

The toe abutment member according to the invention consequently provides a very high degree of safety in combined falling movements consisting of both forward motion and twisting motion.

In the event of a forward-fall alone, the feeler element 18 is depressed and there is no resistance to release of the ski boot from the heel-holding member (not shown in the drawings).

As soon as the abnormal stresses developed during skiing have disappeared or as soon as the ski boot has been disengaged from the binding, the springs 8 produce action on the lateral arms 19 by means of the lugs 21 in order to restore the feeler element 18 to its initial position as shown in FIGS. 1 and 2.

It would also be possible to provide a small additional spring (not shown) for the purpose of assisting the return of the feeler element 18 to its raised top position.

The feeler device according to the invention is very simple and very effective while being inexpensive to produce by reason of the fact that it is incorporated in the toe abutment member itself and is therefore not connected to this latter by complicated means such as link-rod systems.

Figure 5:
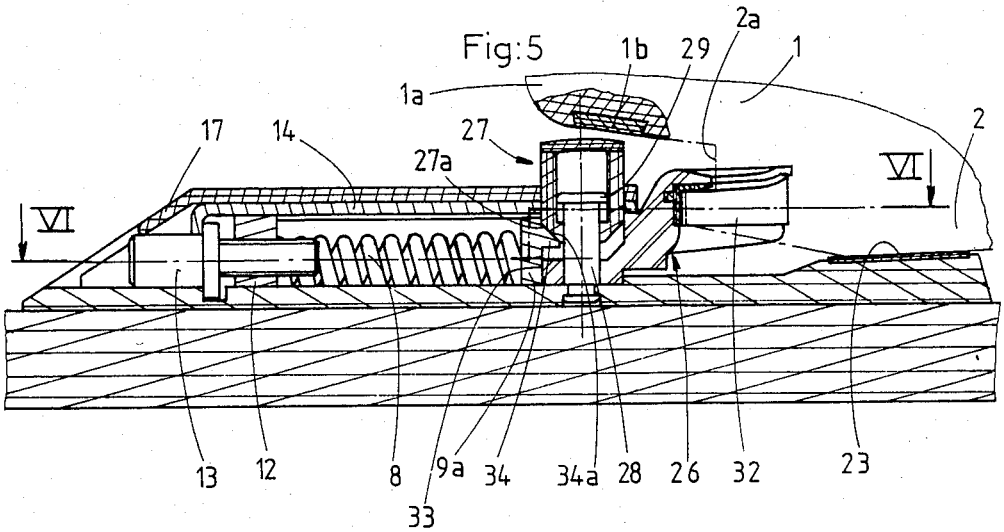
FIG. 5 is a longitudinal sectional view taken along line V—V of FIG. 6 and showing a second embodiment of the toe abutment member according to the invention, in which the feeler element is shown in the raised position.
Figure 6:
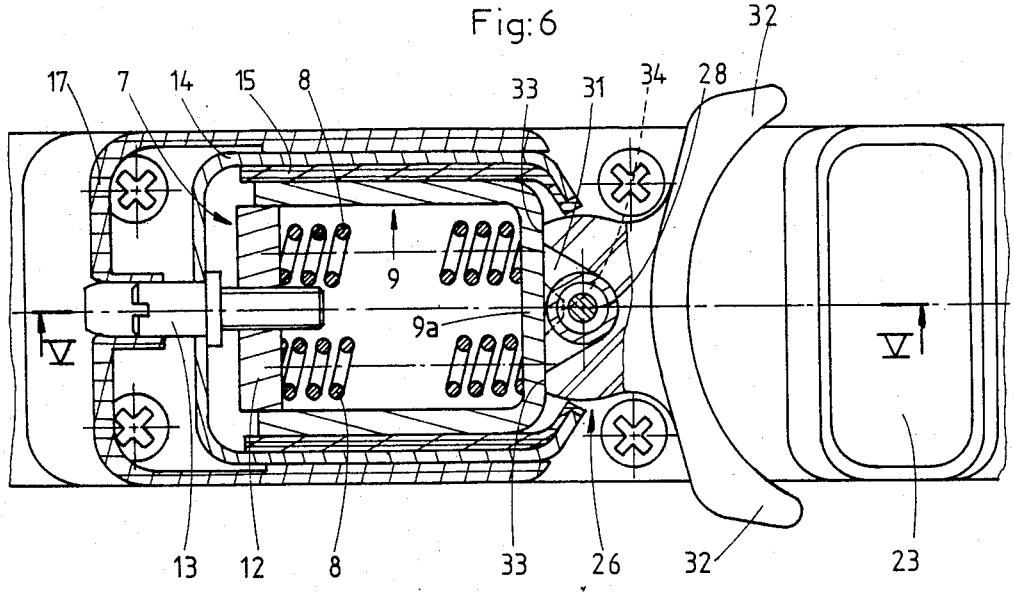
FIG. 6 is a fragmentary part-sectional horizontal top view taken along line VI—VI of FIG. 5.

In the second embodiment illustrated in FIGS. 5 to 8, the feeler unit is constituted by a push-member 27 slidably mounted around the stationary pivot 28 for vertical displacement on the latter. The push-member 27 is therefore of hollow construction as shown in FIG. 5 whilst the head of the pivot 28 is provided with a projecting annular rim 29 which serves as a top end-of-travel stop for the push-member 27.

Said push-member and the pivot 28 are housed within a cavity 31 which is formed within the jaw unit 26 and is flared-out towards the front end of the ski. The two noses thus formed terminate in vertical cams or flat bearing faces 33 on which the cross-piece 9*a* of the piston 9 is brought to bear under the thrust exerted by the springs 8. The jaw unit 26 is provided with two boot-retaining arms 32 which are similar to the retaining arms 4.

The piston 9 is provided on that face which is applied against the flat bearing face 33 with a central lug 34 having an inclined surface or ramp 34*a* against which is slidably applied a corresponding ramp 27*a* formed at the lower end of the push-member 27 and consisting of a conical portion, for example.

In all other respects, the design of the toe abutment member is identical with that of the abutment member shown in FIGS. 1 to 4.

It will be noted that the projecting front portion 1*a* of the ski-boot toe-cap is provided with a reinforcement insert 1*b* which is intended to come into contact with the push-member 27 in such a manner as to prevent any deformation of the wall of the toe-cap extension 1*a* at this point. It is preferable to ensure that the insert 1*b* has good sliding characteristics.

The operation of the toe abutment member of FIGS. 5 to 8 is as follows: while normal skiing is in progress, the push-member 27 is maintained in the raised position by the lug 34 which is rigidly fixed to the piston 9, this being achieved by means of the corresponding inclined surfaces or ramps 34*a*, 27*a*.

In the event of a forward fall, the projecting front portion 1*a* of the ski boot is applied against the push-member 27 by means of the reinforcement 1*b*. Said push-member slides vertically downwards along the pivot 28. The ramp 27*a* causes the ramp 34*a* carried by the piston lug 34 to be thrust towards the front end of the ski, with the result that the piston 9 is moved away from the flat bearing face 33.

Figure 7:
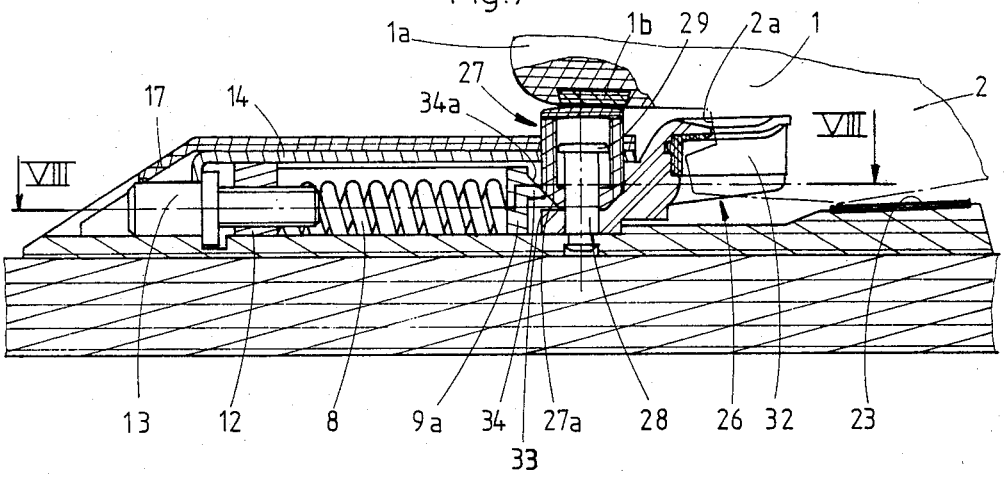
FIG. 7 is a longitudinal sectional view taken along line VII—VII of FIG. 8, in which the push-member is shown in the lowered position at the time of a forward fall and in which the piston has been moved away from its flat bearing face.
Figure 8:
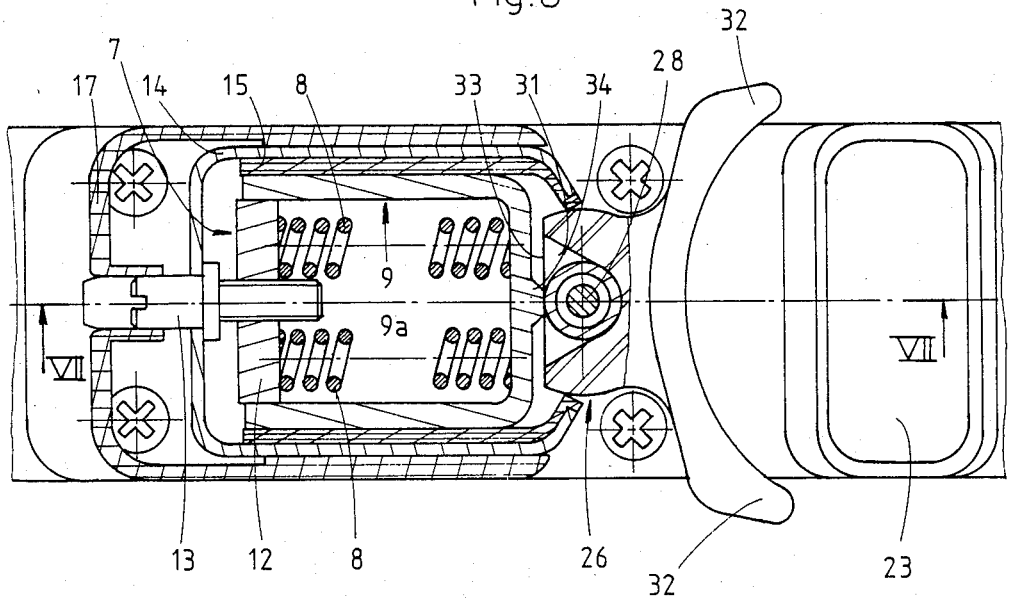
FIG. 8 is a fragmentary part-sectional horizontal top view taken along line VIII—VIII of FIG. 7.

On completion of this movement, the push-member 27, the piston 9 and the ski boot 1 are in the positions illustrated in FIGS. 7 and 8 in which the inherent stiffness of release of the resilient locking mechanism is reduced since the piston 9 is no longer applied against the bearing face 33 (as shown in FIGS. 7 and 8). This makes it possible to compensate for parasitic friction forces, with the result that the overall stiffness of release of the toe abutment member remains practically unchanged.

Figure 9:
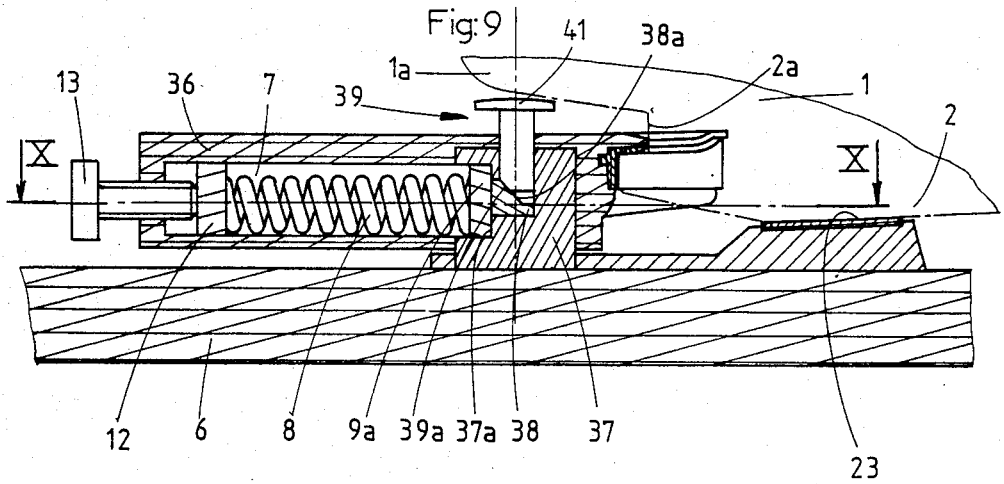
FIG. 9 is an axial longitudinal sectional view taken along line IV—IV of FIG. 10 and showing a third embodiment of the toe abutment member according to the invention, the feeler element being shown in the raised position.

In the third embodiment of the toe abutment member illustrated in FIGS. 9, 10 and 10*a*, the jaw unit 35 is rigidly fixed to the body 36 of the abutment member, the resilient locking mechanism 7, 9 being housed within the interior of said body. The body 36 is rotatably mounted on a stationary vertical pivot member 37 having a flat portion 37*a* against which is applied the cross-piece 9*a* of the piston 9. An adjusting screw 13 screwed into the body 36 serves to modify the stiffness of release exerted by the springs 8 which constitute the resilient locking system 7.

Within the stationary pivot member 37 are mounted a wedge-shaped slide-block 38 which is guided for displacement along the axis of the ski as well as a feeler constituted by a push-member 39 having an enlarged head 41 which is capable of vertical displacement along the axis of the pivot member 37.

The lower end of the push-member 39 has an inclined plane 39*a* which is applied against a complementary inclined plane 38*a* formed on the slide-block 38.

When looking from above, the slide-block 38 has the shape of a T and the enlarged end of said slide-block extends within the flat portion 37*a* towards the front end of the ski and opposite to the cross-piece 9*a* of the piston 9.

At this level, the width d of the slide-block 38 is smaller than the width D of the flat portion 37*a* (as shown in FIG. 10*a*).

At the time of a forward fall, the projecting front portion 1*a* of the ski-boot toe-cap bears on the head 41 of the push-member 39 which slides vertically downwards within the pivot member 37 and causes the slide-block 38 to move forward by means of the ramps 39*a* and 38*a*. The piston 9 is therefore moved away from the flat portion 37*a* of width D and is now applied against the front face of width d of the slide-block 38. By reason of the reduction in mechanical advantage (which has decreased from D to d), the toe abutment release torque is consequently of lower value, thus providing compensation for parasitic stresses arising from friction forces.

The fourth embodiment of the toe abutment member illustrated in FIGS. 11 and 12 comprises two independent arms 42 each mounted for pivotal displacement about a vertical axis 43. The arms 42 are each provided with a nose 44. Said noses are directed towards each other and adapted to engage in an annular groove 45 formed in the head 46 of a tie-bolt 47 disposed along the axis of the ski 6.

The stem 48 of the tie-bolt 47 is guided within a collar 51 formed at the rear end of the stationary abutment body 49. The front portion of the stem 48 is provided with a screw-thread and fixed by screwing in a member 53 which is guided in translational motion within the body 49 for displacement along the axis of the ski. A compression spring 52 housed within the body 49 and applied against the rear end of this latter produces action on the member 53 in order to ensure that the head 46 of the tie-bolt is powerfully applied against the collar 51 and correlatively in order to maintain the arms 42 in the boot-retaining position.

This type of toe abutment member is well-known and commercially available. According to the invention, the toe abutment member is equipped with a feeler device. This device is constituted by a pedal 54 pivotally mounted on a cross-pin 55 carried by the body 49 and located above the annular groove 45. The pedal 54 has a cross-piece 56 located at a predetermined height above the cover of the box unit 49 in order to be practically in contact with the projecting front portion 1*a* of the ski boot. Said pedal also has a lower extension 57 having the shape of a nose and adapted to engage within the groove 45.

As in the preceding embodiments, the top face of the pedal 54 is advantageously fitted with a bearing plate 58 formed of material having a low coefficient of friction and interchangeable if necessary.

Under these conditions, during normal skiing activities, the feeler 54 is in the position illustrated in FIGS. 11 and 12 in which it is located above the box unit 49 and is not subjected to any pressure of the ski boot. At the time of a forward fall, the overhanging front portion 1*a* of the ski boot bears on the pedal 54 which undergoes a movement of pivotal displacement about the axis 55, with the result that the lower extension 57 displaces the head 46 of the piston 47 towards the ski boot or in other words in the direction which facilitates separation of the arms 42 and release of the ski boot.

This result is made possible by the fact that the cross-piece 56 of the pedal 54 extends towards the front end of the ski with respect to the axis 55 of pivotal motion.

After release of the ski boot, the restoring spring 52 returns the locking mechanism and the feeler 54 to their initial positions.

The invention is not limited to the different embodiments hereinabove described and can accordingly extend to a large number of alternative forms of construction. From this it follows that the feeler members described can be designed or constructed in any equivalent manner on condition that they remain capable of vertical displacement under the pressure exerted by the front overhanging portion of the toe-cap of the truncated ski boot and cause a reduction in stiffness of release of the abutment member.

Thus it follows, for example, that provision could be made for adjustment of the mechanical advantage ratio between the vertical force exerted on the feeler and the resultant horizontal force exerted on the piston of the resilient locking mechanism. In the case of the first embodiment, this could be achieved by providing means for varying the axis of pivotal motion of the feeler 18 against the cover of the box unit 14, for example by providing a plurality of notches 22 on each lateral arm 19.

It would also be possible to equip the top face of the feeler element with rolling members (pins or rollers) instead of a sliding plate.

What is claimed is:

1. A ski-binding toe abutment member adapted to cooperate with a ski boot having a ski boot upper and provided with a sole having a truncated front end and a tow-cap extension in overhung relation to said truncated front end, comprising a jaw unit formed by two arms, extending about and retaining the said truncated front end of the sole, said retaining arms being rotatably mounted on at least one vertical pivot, a resilient mechanism acting upon said arms to lock the same in a boot-retaining position thereby providing an adjustable force or inherent stiffness of release, and a feeler element adapted to be in contact with the toe-cap extension of the ski boot and positioned to produce action on the resilient locking mechanism in the event of a forward fall in order to reduce the inherent stiffness of release of said mechanism said feeler element including a yoke extending transversely with respect to the ski, said feeler element being placed beneath the toe-cap extension of the ski-boot upper in close proximity to said toe-cap extension during normal skiing and being vertically displaceable in a downward direction under the thrust exerted by said toe-cap extension at the time of a forward fall the toe-cap extension of the ski-boot upper causing a downward pivotal displacement of the yoke about an axis transverse to the ski which exerts correlatively on said resilient mechanism, a thrust which tends to move said resilient mechanism away from the jaw unit to produce a reduction in said inherent stiffness of release.

2. A toe abutment member according to claim 1, in which the resilient locking mechanism comrises a U-shaped piston housed within a box unit so as to be capable of displacement in sliding motion along the longitudinal axis of the ski, said piston being continuously urged by at least one spring against a flat bearing surface of the retaining jaw unit, said yoke being provided with two lateral arms interposed between the sides of the piston and the box unit and adapted to cooperate with lateral lugs of said piston so that, under normal skiing conditions, said lugs maintain the yoke in the raised position by producing action on its lateral arms and that, in the event of a forward fall, wherein said piston moves away from the flat bearing face of the jaw unit.

3. A toe abutment member according to claim 1, in which the resilient locking mechanism comprises a U-shaped piston housed within a box unit so as to be capable of displacement in sliding motion along the longitudinal axis of the ski, said piston being continuously urged by at least one spring against a flat bearing surface of said jaw unit, wherein the piston is provided on that face which is applied against said flat bearing face of the jaw unit with a lug provided with a ramp against which is slidably applied a push-member provided with a corresponding ramp and constituting the feeler element, said push-member being slidably mounted around the stationary pivot for vertical displacement on said pivot and resiliently urged to its raised position by the lug of said piston.

4. A toe abutment member according to claim 1, in which the boot-retaining jaw unit is rigidly fixed to a box unit and the complete assembly is rotatably mounted on the vertical pivot, said pivot being provided with a flat portion against which the piston of the resilient locking mechanism is applied, wherein the feeler element is constituted by a push-member mounted for vertical sliding motion within the stationary pivot and adapted to cooperate with a slide-block mounted within said stationary pivot between said push-member and said piston, the lower end of the push-member being provided with an inclined bearing surface slidably applied against a corresponding inclined bearing surface of the slide-block.

5. A toe abutment member according to claim 4, wherein the slide-block face which bears on the piston is smaller in width than the flat portion of the pivot.

6. A toe abutment member according to claim 1, in which the jaw unit is constituted by two arms each mounted for pivotal displacement about a vertical axis and engaged with a central tie-bolt actuated by a resilient member, wherein the feeler element is formed by a pedal pivotally mounted on a cross-pin carried by a casing which contains said resilient member, said pedal being provided with a lower extension engaged in the tie-bolt so that a downward pivotal movement of the pedal at the time of a forward fall produces a displacement of the tie-bolt by means of said lower extension of said pedal in a direction which facilitates opening-out of said arms or in other words a displacement towards the ski boot.

7. A toe abutment member according to claim 1, wherein the top face of the feeler element is fitted with small slide-plates which are detachable.

* * * * *